US010874156B2

(12) United States Patent
Oh et al.

(10) Patent No.: US 10,874,156 B2
(45) Date of Patent: Dec. 29, 2020

(54) HEAT-STORING AND WARMTH-RETAINING FLEECE AND METHOD FOR MANUFACTURING SAME

(71) Applicant: HYOSUNG TNC CORPORATION, Seoul (KR)

(72) Inventors: Sung Jin Oh, Anyang-si (KR); Min Suk Lee, Anyang-si (KR)

(73) Assignee: HYOSUNG TNC CORPORATION, Seoul (KR)

( * ) Notice: Subject to any disclaimer, the term of this patent is extended or adjusted under 35 U.S.C. 154(b) by 432 days.

(21) Appl. No.: 15/518,991

(22) PCT Filed: Nov. 27, 2015

(86) PCT No.: PCT/KR2015/012812
§ 371 (c)(1),
(2) Date: Apr. 13, 2017

(87) PCT Pub. No.: WO2016/104968
PCT Pub. Date: Jun. 30, 2016

(65) Prior Publication Data

US 2017/0238635 A1 Aug. 24, 2017

(30) Foreign Application Priority Data

Dec. 22, 2014 (KR) ..... 10-2014-0186335

(51) Int. Cl.
*D06C 11/00* (2006.01)
*D01F 6/62* (2006.01)
(Continued)

(52) U.S. Cl.
CPC ..... *A41D 31/06* (2019.02); *D01D 5/24* (2013.01); *D01D 5/30* (2013.01); *D01D 5/34* (2013.01);
(Continued)

(58) Field of Classification Search
CPC ..... A41D 31/0033; A41D 31/06; A41D 2400/10; A41D 2500/20; A41D 2500/10;
(Continued)

(56) References Cited

U.S. PATENT DOCUMENTS

2008/0308775 A1* 12/2008 Yabuki ..... D01F 1/10 252/587

FOREIGN PATENT DOCUMENTS

EP 0302141 2/1989
JP 0369675 3/1991
(Continued)

OTHER PUBLICATIONS

"KR101212986_Machine Translation" is a machine translation of KR 10-1212986. (Year: 2012).*
(Continued)

*Primary Examiner* — Marla D McConnell
*Assistant Examiner* — Larissa Rowe Emrich
(74) *Attorney, Agent, or Firm* — Hamre, Schumann, Mueller & Larson, P.C.

(57) ABSTRACT

The present invention relates to a heat-storing and retaining fleece using a polyester yarn containing composite metal oxide particles. The heat-storing and retaining fleece of the present invention exhibits an excellent far-infrared emission property, an excellent heat-storing and retaining property, excellent spinning processability, and excellent dyeability.

5 Claims, 4 Drawing Sheets

(51) Int. Cl.

| | |
|---|---|
| ***D01F 1/10*** | (2006.01) |
| ***D04B 1/04*** | (2006.01) |
| ***D01D 5/24*** | (2006.01) |
| ***A41D 31/06*** | (2019.01) |
| ***D01D 5/30*** | (2006.01) |
| ***D01D 5/34*** | (2006.01) |
| ***D03D 27/00*** | (2006.01) |

(52) U.S. Cl.
CPC ..... *D01F 1/10* (2013.01); *D01F 6/62* (2013.01); *D03D 27/00* (2013.01); *D04B 1/04* (2013.01); *D06C 11/00* (2013.01); *A41D 2400/10* (2013.01); *A41D 2500/10* (2013.01); *A41D 2500/20* (2013.01)

(58) Field of Classification Search
CPC ..... D04B 1/02–04; D04B 1/16; D04B 9/12; D04B 21/02–04; D04B 21/14; D01D 5/24; D01D 5/30; D01D 5/34; D03D 27/00; D01F 6/62; D01F 1/10; D01F 1/106; D06C 11/00; D06C 3/08–10; D10B 2331/04; D10B 2401/22; D10B 2403/0111; D10B 2403/0121
USPC ..... 428/91, 95, 97, 323, 325, 372, 398, 480, 428/87; 442/304–319
See application file for complete search history.

(56) References Cited

FOREIGN PATENT DOCUMENTS

| | | | | |
|---|---|---|---|---|
| JP | 2001-207373 | | | 8/2001 |
| JP | 2001207373 | A | * | 8/2001 |
| KR | 10-2007-0085850 | | | 8/2007 |
| KR | 10-2011-0015319 | | | 2/2011 |
| KR | 10-2012-0076909 | | | 7/2012 |
| KR | 101212986 | B1 | * | 12/2012 |
| KR | 101232405 | B1 | * | 2/2013 |
| KR | 10-1354261 | | | 2/2014 |

OTHER PUBLICATIONS

"JP2011207373_Machine Translation" is a machine translation of JP 2001-207373. (Year: 2001).*
"KR101232405_Machine Translation" is a machine translation of KR-101232405-B1. (Year: 2013).*
International Search Report, issued in the corresponding International PCT application No. PCT/KR2015/012812, dated Mar. 8, 2016, 4 pages.

* cited by examiner

* Test equipment and conditions

1. Temperature/humidity chamber : EBR (Walk-in Type), Espec
2. Thermometer : Cat, TNB-200(LT-8B), Gram
3. Light source : 220V/500W/3200K bulb (Iwasaki Co.)
4. Irradiation distance : 50 cm
5. Surface to be irradiated : surface
6. Surface to be measured : back surface
7. Irradiation time : 60 min
8. Temperature and humidity in chamber : (15±1)℃, (65±4)% RH

HEAT-STORING AND WARMTH-RETAINING FLEECE AND METHOD FOR MANUFACTURING SAME

TECHNICAL FIELD

The present invention relates to a heat-storing and retaining fleece and a method for producing the same, and more particularly to a heat-storing and retaining fleece having an excellent heat-storing and retaining property, in which a yarn containing cesium tungsten oxide-based metal oxide particles incorporated therein is used as a component of a ground yarn, and a method for producing the same.

BACKGROUND ART

With the development of technology, synthetic fibers have also been improved to have physical properties comparable to those of natural fibers, and thus synthetic fibers having various functionalities have been used. In particular, polyesters represented by polyethylene terephthalate have many excellent properties, and thus have been widely used not only for textile applications but also for industrial applications.

Hitherto, fleece, i.e., a soft napped fabric having excellent heat-retaining properties similar to those of wool, has been used for applications, including clothing. In particular, fleece is excellent in terms of physical properties including pilling, strength, water content, color fastness to light, color fastness to washing, etc., and thus fleeces including polyester materials have been popularized.

Recently, in the polyester textile industry, high value-added differentiated materials have been actively developed. In an effort to overcome the disadvantages of polyesters and to confer new advantages thereto, research has been conducted to improve the heat-storing and retaining property of polyester fibers.

As an example, European Patent No. 302141 discloses a heat-storing and retaining polyester fiber which contains fine zirconium carbide particles. However, fine zirconium carbide particles have a disadvantage in that they cannot provide fabric products having various colors because they take on a gray or black color when being incorporated into blended yarns.

Meanwhile, Japanese Unexamined Patent Application Publication No. Hei 3-69675 discloses a method for producing a far-infrared polyester fiber, the method including: adding 0.5-9.0 wt % of an oxide ceramic fine powder, such as zirconium oxide, silicon oxide, aluminum oxide or the like, to a polymer; preparing a slurry of ethylene glycol by using a high-speed mixer; introducing the slurry into an ester reaction tube; and kneading the introduced slurry. The polyester fiber which is produced by this method has good whiteness, but has a problem in that the production of filaments is difficult because the dispersibility of a large amount of ceramic particles is poor.

DISCLOSURE

Technical Problem

The present invention is intended to overcome the above-described problems of the conventional art, and an object of the present invention is to provide a heat-storing and retaining fleece having an excellent heat-storing and retaining property, excellent dyeability, and a far-infrared emission property.

Another object of the present invention is to provide a method for producing a heat-storing and retaining fleece having an excellent heat-storing and retaining property, excellent dyeability, and a far-infrared emission property.

Technical Solution

In order to accomplish the above objects, an aspect of the present invention is directed to a heat-storing and retaining fleece configured to have a fleece texture in which a pile yarn whose loop is fixed to a ground yarn is napped, wherein the pile yarn includes a polyester yarn, and the ground yarn contains a polyester fiber containing, based on the weight of the ground yarn, 0.05-3.0 wt % of composite metal oxide particles comprised of 0.02-0.35 wt % of $WO_3$, 0.01-0.15 wt % of $Cs_2O$ and 0.02-2.5 wt % of $TiO_2$.

Another aspect of the present invention is directed to a method for producing a pile knitted fabric including a pile yarn portion and a ground yarn portion, wherein a polyester fiber, containing, based on the weight of the ground yarn, 0.05-3.0 wt % of composite metal oxide particles comprised of 0.02-0.35 wt % of $WO_3$, 0.01-0.15 wt % of $Cs_2O$ and 0.02-2.5 wt % of $TiO_2$, is used as a component of the ground yarn, a polyester yarn is disposed in the pile yarn portion, and the yarns are knitted and then heat-treated.

Still another aspect of the present invention is directed to cold weather protective clothing manufactured using the heat-storing and retaining fleece of the present invention.

Advantageous Effects

The heat-storing and retaining fleece according to the present invention exhibits an excellent far-infrared emission property, an excellent heat-storing and retaining property, and excellent spinning processability.

Heat-storing and retaining fleeces according to various embodiments of the present invention emit far-infrared rays from far-infrared-emitting composite metal oxide particles distributed in the fiber of the ground yarn to thereby provide thermal insulation and health promotion effects, include an air layer in the fiber to thereby exhibit an excellent heat-storing and retaining property, and also have excellent spinning processability and excellent dyeability.

BEST MODE

The present invention will be described in greater detail below with reference to the accompanying drawings.

Figure 2:
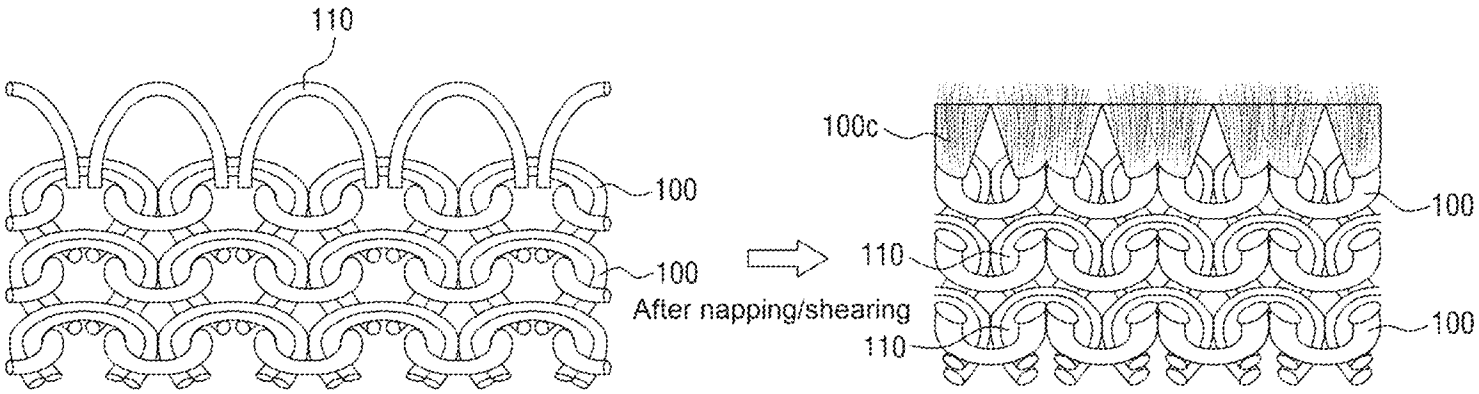
FIG. 2 is a schematic sectional view of a fleece fabric according to an embodiment of the present invention.

FIG. 2 is a schematic sectional view of a fleece fabric according to an embodiment of the present invention. Referring to FIG. 2, the fleece of the present invention is a knitted fabric formed by circular pile knitting, and may be composed of a polyester material. A knitted pile fabric is a special fabric in which the pile of a pile yarn is woven in the pore of a knitted fabric, and the knitted pile fabric has unique gloss, unique texture, sufficient elasticity, and a sufficient heat-retaining property.

A heat-storing and retaining fleece according to an embodiment of the present invention is a fleece configured to have a fleece texture in which a pile yarn 110 whose loop is fixed to a ground yarn 100 is napped, and is characterized in that the pile yarn 100 includes a polyester yarn, and the ground yarn 100 contains a polyester fiber containing, based on the weight of the ground yarn, 0.05-3.0 wt % of composite metal oxide particles comprised of 0.02-0.35 wt % of $WO_3$, 0.01-0.15 wt % of $Cs_2O$ and 0.02-2.5 wt % of $TiO_2$.

Referring to FIG. 2, the fleece according to the present invention has the structure shown on the left side before napping, and has the structure shown on the right side after napping. Specifically, the fleece of the present invention has a configuration in which a knitted structure and a pile loop are combined with each other. First, the knitted structure is a horizontal structure, such as a general single knitted structure, in which ground loops 100 are combined with each other while they are regularly arranged in a matrix form. Pile loops 110 in which piles are connected to this knitted structure are included in the knitted structure while forming a loop having a shape corresponding to each ground loop 100. At the ends of the pile loops 110, fleeces 110*c* are formed after napping.

The content of the composite metal oxide additive in the yarn is preferably 0.05-3.0 wt %, more preferably 0.3-2.5 wt %. When the composite metal oxide additive is contained in an amount of less than 0.05 wt %, the heat-storing and retaining property decreases. In contrast, when the composite metal oxide additive is contained in an amount of more than 3.0 wt %, disadvantages arise in that pack pressure increases, spinning processability decreases, the appearance of the yarn is poor (yarn breakage and loop breakage), and the production cost increases.

Furthermore, the pile yarn in the fleece circular knitted fabric according to the present invention is made of conventional polyester fiber, and the content of the pile yarn in the fabric is 55-80 wt %. The ground yarn has is obtained either by knitting only a heat-storing and retaining polyester fiber containing the composite metal oxide particles, or by knitting the heat-storing and retaining polyester and conventional polyester at a weight ratio of 1:1-1:10 wt %. The content of the ground yarn in the fabric is 20-45 wt %, and the content of the heat-storing and retaining polyester in the fabric is 5-45 wt %.

The content of the heat-storing and retaining polyester fiber containing the composite metal oxide particles is preferably 5-45%, more preferably 10-20 wt %. When the content of the heat-storing and retaining polyester fiber is less than 5 wt %, the heat-storing and retaining property is insufficient because the content of the heat-storing and retaining fiber is excessively low. In contrast, when the content of the heat-storing and retaining polyester fiber is more than 45 wt %, a disadvantage arises in that the production cost increases because the heat-storing and retaining polyester fiber also needs to be applied to the pile yarn.

The fleece having an excellent heat-storing and retaining property according to the present invention can provide a fabric product exhibiting an excellent heat-storing and retaining property and having excellent knitting and dyeability properties even when the heat-storing and retaining fiber containing the cesium tungsten oxide-based composite metal oxide particles is used as the ground yarn of the fleece in an amount of only 45 wt % or less.

The composite metal oxide particles contained in the ground yarn preferably have a particle size of 0.05-2.0 μm.

When the size of the composite metal oxide particles contained in the ground yarn is smaller than 0.05 μm, the functionality thereof decreases, and it is difficult to ensure the dispersibility thereof. In contrast, when the size of the composite metal oxide particles is greater than 2.0 μm, a problem may arise in terms of spinning processability, particularly the spinning processability of high monofilament yarns having a single-yarn fineness of 1 denier or less.

Furthermore, the number-average distribution of the number of particles having a size of 0.05-1.0 μm in the composite metal oxide particles in the yarn is preferably 50-65%. The particle size distribution of inorganic particles has a direct influence on the dispersibility thereof during mixing thereof. When the distribution of particles having a size smaller than the average particle size in the composite metal oxide particles is excessively broad, problems may arise in that the particles aggregate to cause a decrease in spinning processability and an increase in pressure. In contrast, when the distribution of particles having a size smaller than the average particle size is excessively narrow, the particles will aggregate rapidly due to an attraction between the molecules, resulting in a considerable decrease in spinning processability. Accordingly, the distribution of particles having a size smaller than the average particle size in the cesium tungsten oxide-based composite metal oxide particles is preferably within the above-specified range in order to prevent the aggregation of the particles.

The polyester yarn containing the composite metal oxide particles contained in the ground yarn of the fleece according to the present invention has a single-yarn fineness of 0.5-3.0 denier, has a yarn section including a hollow portion, and has a hollow ratio of 10-40% and a far-infrared emissivity of 0.88 or higher in the wavelength range from 5 to 20 μm. In addition, a heat-storing and retaining property measured by a lamp method is 1.5° C. or higher, and thus the heat-storing and retaining effect of the polyester fiber is very excellent.

The ratio of a central hollow portion, in which an air layer is formed, in the polyester fiber of the fleece according the present invention, is 10-40%, preferably 20-30%. In this case, when the ratio of the hollow portion is lower than 10%, the desired heat-retaining effect of the air layer cannot be expected. In contrast, when the ratio of the hollow portion is higher than 40%, problems may arise in that the processability of the fiber in production processes decreases, the wearing feeling of the fiber is excessively light, and the color development property of the fiber decreases.

The heat-storing and retaining fleece of the present invention emits far-infrared rays from far-infrared-emitting particles distributed therein to thereby exhibit thermal insulation and health promotion effects, and has an air layer formed therein to thereby provide an excellent heat-storing and retaining property. Therefore, the fleece of the present invention may be used to manufacture a targeted fabric product (woven or knitted fabric), thereby manufacturing winter clothes, ski suits, winter uniforms, blouses, coats, working clothes, curtains, etc.

The yarn is produced by spinning through a spinning nozzle having a sectional shape that enables the yarn to have a hollow sectional shape, such as a hollow, cruciform, circular, semicircular, oval, C, D, sheath-core type or cross-bar shape.

Another aspect of the present invention is directed to a method for producing the fleece. In the present invention, in the production of a fleece knitted fabric including a pile yarn portion and a ground yarn portion, a polyester fiber, containing, based on the weight of the ground yarn, 0.05-3.0 wt % of composite metal oxide particles composed of 0.02-0.35 wt % of $WO_3$, 0.01-0.15 wt % of $Cs_2O$ and 0.02-2.5 wt % of $TiO_2$, is used as a component of the ground yarn, a polyester yarn is disposed in the pile yarn portion, and yarns are knitted and then heat-treated.

Thereafter, the produced fabric is subjected to a napping operation using a general napping machine to thereby produce a napped fabric having a pile yarn on both sides thereof. The napping operation may be performed on one or both sides of the fabric. If necessary, a shearing operation is performed such that the length of piles in the napped fabric is made uniform. Furthermore, if necessary, the fabric is dyed with a desired color according to a conventional method.

In the present invention, a multi-lobal heat-storing and retaining yarn having a hollow section may be produced by preparing a separate master batch chip including a polymer and far-infrared-emitting ceramic fine powder, mixed-spinning the master batch chip to produce a heat-storing and retaining fiber, and modifying the section of the yarn to maximize the content of an air layer in the yarn and a fabric product in order to maximize far-infrared emission and heat-retaining effects.

In the method according to an embodiment of the present invention, cesium tungsten oxide-based composite metal oxide particles are melt-mixed with polyester to prepare a polyester master batch chip, and then the prepared master batch chip is mixed with a general polyester chip. The chip mixture is spun using a spinning nozzle having a sectional shape that enables the spun fiber to have a hollow sectional shape. After the spinning, the spun fiber is cooled using a cooling device including a central rotational outflow quenching unit and a nozzle-warming heater, thereby producing a polyester yarn which is to be included in the ground yarn of a heat-storing and retaining fleece.

The yarn which is used in the ground yarn of the present invention may be produced using a spinning nozzle having a hollow sectional shape so that the spun fiber may contain an air layer. For example, the yarn may be produced using a conjugate yarn spinning nozzle which enables the spun fiber to have a sectional shape, such as a hollow, cruciform, circular, semicircular, oval, D-shaped, sheath-core type, or crossbar type shape, in order to contain an air layer.

The present invention will be described in greater detail with reference to examples below. However, these examples are merely for an illustrative purpose, and the range of protection of the present invention is not limited thereto.

Example 1

Figure 1:
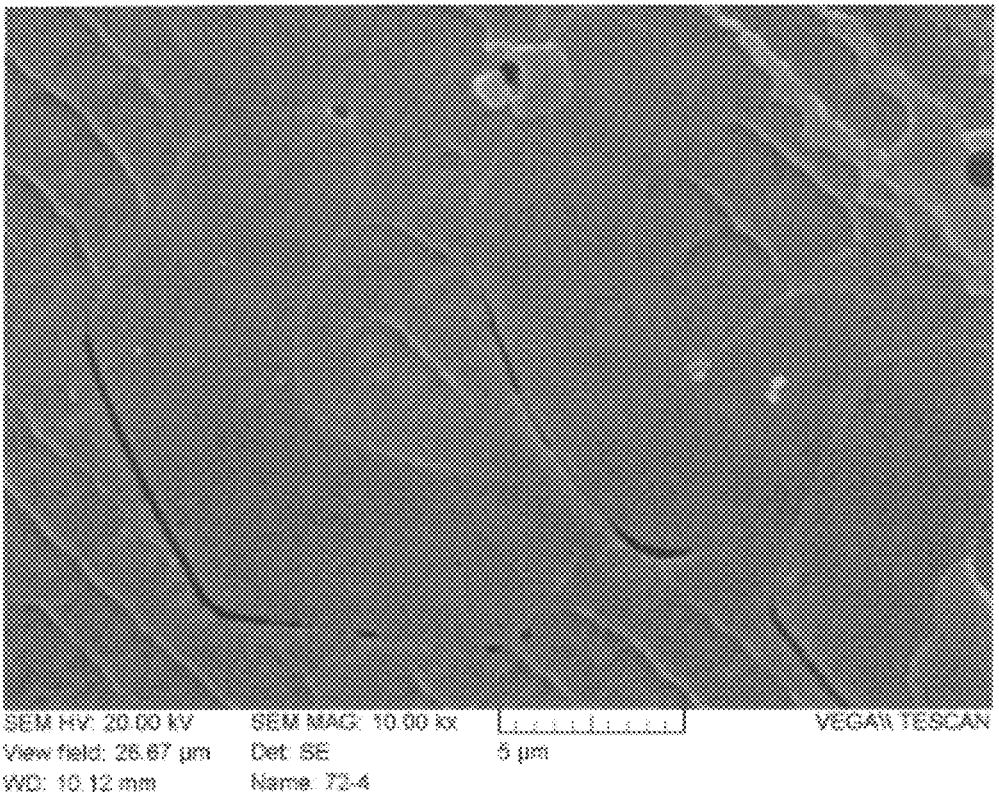
FIG. 1 is a photo of a heat-storing and retaining fleece produced in an embodiment of the present invention.

Twelve 75-denier/72-filament heat-storing and retaining false-twist yarns containing 0.1 wt % of $WO_3$, 0.03 wt % of $Cs_2O$ and 0.3 wt % of $TiO_2$ and having a C-shaped sectional shape and thirty 75-denier/72-filament general polyester false-twist yarns having a circular sectional shape were used as ground yarns, and forty-two 75-denier/72-filament general polyester false-twist yarns having a circular sectional shape were used as pile yarns. These yarns were knitted in a Terry knitting machine. In this case, the weight ratio between the ground yarn and the pile yarn in the knitted fabric for fleece was 4:6, and the content of the heat-storing and retaining fiber in the knitted fabric was about 11.4%. The Terry knitted fabric for fleece was cylinder-refined in the presence of 2 g/l of a refining agent at 95° C. for 30 minutes, and was then cylinder-dyed with a conventional black dispersion dye in the presence of 11% OWF at 130° C. for 40 minutes. The dyed Terry knitted fabric for fleece was subjected to reduction cleaning in the presence of 2 g/l of a reduction cleaning agent and 2 g/l of caustic soda at 80° C. for 20 minutes, and was then pre-tentered at a temperature of 190° C. The pile yarns on one side of the pre-tentered Terry knitted fabric for fleece were napped in a general napping machine to produce a fleece nipped on one side thereof, and were then sheared in order to make the length of the napped pile yarns uniform. Finally, the fleece nipped on one side thereof was post-tentered at 190° C. A photograph of the cross-section of the produced fiber is shown in FIG. 1, and the heat-storing and retaining property of the obtained heat-storing and retaining polyester fleece was evaluated, and is shown in Table 1 below.

Example 2

Thirty-six 75-denier/72-filament heat-storing and retaining false-twist yarns containing 0.1 wt % of $WO_3$, 0.03 wt % of $Cs_2O$ and 0.3 wt % of $TiO_2$ and having a C-shaped sectional shape and six 75-denier/72-filament general polyester false-twist yarns having a circular sectional shape were used as ground yarns, and forty-two 75-denier/72-filament general polyester false-twist yarns having a circular sectional shape were used as pile yarns. These yarns were knitted in a Terry knitting machine. In this case, the weight ratio between the ground yarn and the pile yarn in the knitted fabric for fleece was 4:6, and the content of the heat-storing and retaining fiber in the knitted fabric was about 34%. The Terry knitted fabric for fleece was cylinder-refined in the presence of 2 g/l of a refining agent at 95° C. for 30 minutes, and was then cylinder-dyed with a conventional black dispersion dye in the presence of 11% OWF at 130° C. for 40 minutes. The dyed Terry knitted fabric for fleece was subjected to reduction cleaning in the presence of 2 g/l of a reduction cleaning agent and 2 g/l of caustic soda at 80° C. for 20 minutes, and was then pre-tentered at a temperature of 190° C. The pile yarns on one side of the pre-tentered Terry knitted fabric for fleece were napped in a general napping machine to produce a fleece nipped on one side thereof, and were then sheared in order to make the length of the napped pile yarns uniform. Finally, the fleece nipped on one side thereof was post-tentered at 190° C. The heat-storing and retaining property of the obtained heat-storing and retaining polyester fleece was evaluated, and is shown in Table 1 below.

Comparative Example 1

Forty-two 75-denier/72-filament general polyester false-twist yarns having a circular sectional shape were used as ground yarns, and forty-two 75-denier/72-filament general polyester false-twist yarns having a circular sectional shape were used as pile yarns. These yarns were knitted in a Terry knitting machine. In this case, the weight ratio between the ground yarn and the pile yarn in the knitted fabric for fleece was 4:6, and a heat-storing and retaining fiber was not used. The Terry knitted fabric for fleece was cylinder-refined in the presence of 2 g/l of a refining agent at 95° C. for 30 minutes, and was then cylinder-dyed with a conventional black dispersion dye in the presence of 11% OWF at 130° C. for 40 minutes. The dyed Terry knitted fabric for fleece was subjected to reduction cleaning in the presence of 2 g/l of a reduction cleaning agent and 2 g/l of caustic soda at 80° C. for 20 minutes, and was then pre-tentered at a temperature of 190° C. The pile yarns on one side of the pre-tentered Terry knitted fabric for fleece was napped in a general napping machine to produce a fleece nipped on one thereof side, and was then sheared in order to make the length of the napped pile yarns uniform. Finally, the fleece nipped on one side thereof was post-tentered at 190° C. The property of the obtained polyester fleece was evaluated, and is shown in Table 1 below.

Methods for Evaluation of Physical Properties

Figure 3:
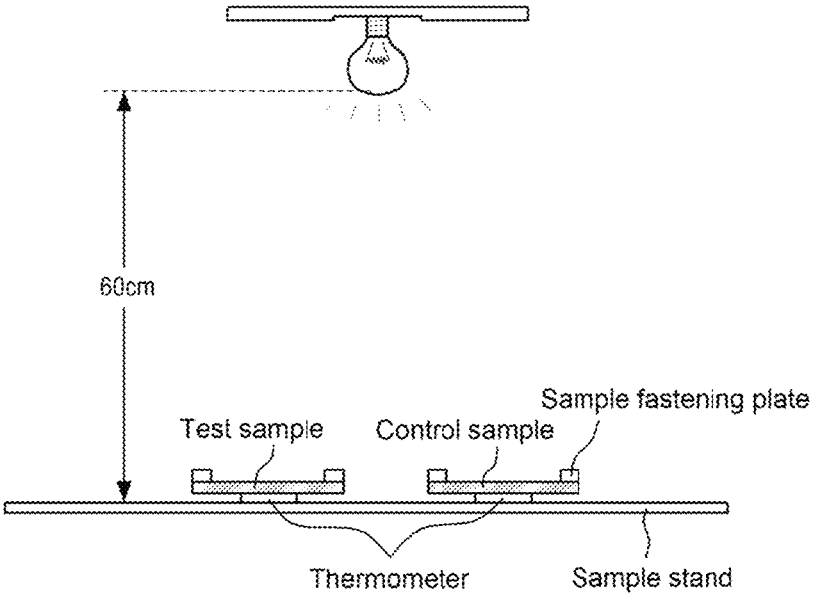
FIG. 3 is a schematic diagram of equipment for measuring the heat-storing and retaining property of a fleece produced in an example of the present invention.

*Thermal Insulation/Insulation Property (a reference lamp method): The equipment shown in FIG. 3 was used. Fabric samples each having a width of 30 cm and a length of 30 cm were prepared and allowed to stand in an artificial climate chamber (temperature: 20±2° C.; relative humidity: 65±4%) for 2 hours. Thereafter, temperature sensors were attached to the respective lower surfaces of the fabric samples, and the fabric samples were irradiated with light from a 500 W light source located at a distance of 50 cm from the fabric samples. The temperatures of the fabric samples were measured at intervals of 1 minute for 60 minutes, and then calculations were performed, as shown in the following equations:

1) Temperature rise (° C.): temperature of fabric sample after light irradiation—temperature of fabric sample before light irradiation;

2) Heat-storing and retaining property (temperature (° C.)): Temperature rise of test sample—temperature rise of control sample

TABLE 1

| Type of Fiber | | Example 1 | Example 2 | Comparative Example 1 |
|---|---|---|---|---|
| Content in fabric | Ground yarn 1 (heat-storing and retaining PET fiber) | 12% | 34% | x |
| | Ground yarn 2 (general PET fiber) | 28% | 6% | 40% |
| | Pile yarn (general PET fiber) | 60% | 60% | 60% |
| Heat-storing and retaining property A (Temp.) | | 1.5 | 5.3 | — |

Figure 4:
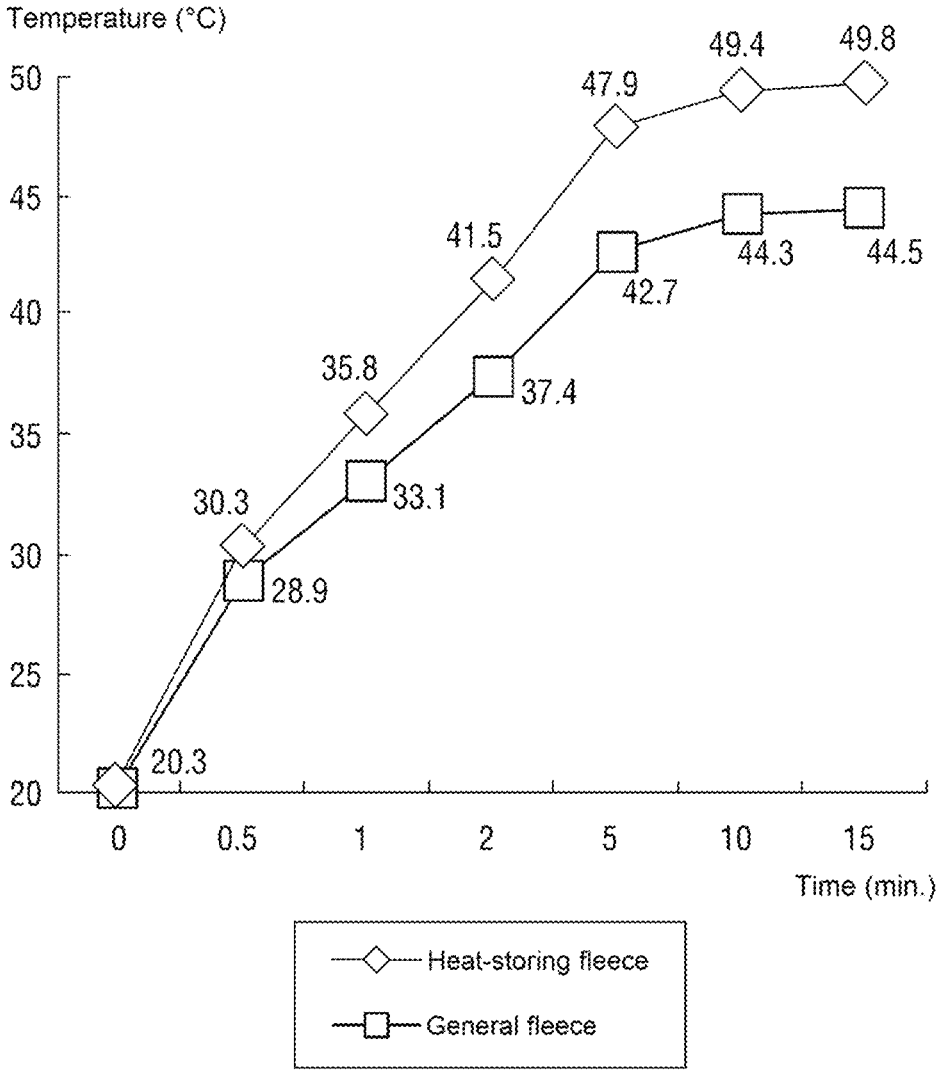
FIG. 4 is a graph illustrating the results of measuring the functionality of a fleece produced in an example of the present invention.

As can be seen from the results in Table 1 above and FIG. 4, the fleece knitted fabric according to the present invention had an excellent heat-storing and retaining property of 1.5° C. or higher.

Although the preferred embodiments of the present invention have been described in detail by way of example, this description is intended merely to describe and disclose exemplary embodiments of the present invention. It will be readily understood by those skilled in the art that various changes, modifications and alterations can be made from the above description and the accompanying drawings without departing from the scope and spirit of the invention. Accordingly, the modifications or changes should be construed as falling within the claims of the present invention.

The invention claimed is:

1. A heat-storing and retaining fleece configured to have a fleece texture in which a pile yarn whose loop is fixed to a ground yarn is napped, wherein the pile yarn includes a polyester yarn, and the ground yarn contains a polyester fiber containing, based on a weight of the ground yarn, 0.05-3.0 wt % of composite metal oxide particles comprised of 0.02-0.35 wt % of $WO_3$, 0.01-0.15 wt % of $Cs_2O$ and 0.02-2.5 wt % of $TiO_2$;

the heat-storing and retaining fleece exhibits a heat-storing and retaining property of 1.5° C. or higher, wherein the heat-storing and retaining property is a temperature difference between the heat-storing and retaining fleece and a reference fleece prepared by the same method as said heat-storing and retaining fleece except for the absence of the composite metal oxide particles at a time point measured in a lamp test employing a 500 watt light source at a distance of 50 cm from the fabric samples while measuring and recording the temperature increase for 15 minutes starting from 20° C., and the ground yarn has a cross-sectional shape including a hollow portion.

2. The heat-storing and retaining fleece of claim 1, wherein the composite metal oxide particles have an average particle size in a range of 0.05-2.0 μm, and a ratio of a number of particles having an average particle size in a range of 0.05-0.1 μm to a total number of the particles in the ground yarn is 50-65%.

3. The heat-storing and retaining fleece of claim 1, wherein the ground yarn containing the composite metal oxide particles has a yarn section including a hollow portion, and has a hollow ratio of 10-40%.

4. The heat-storing and retaining fleece of claim 3, wherein the ground yarn is a yarn spun through a spinning nozzle having a sectional shape that enables the ground yarn to have the cross-sectional shape which is a cruciform, circular, semicircular, oval, C, D, sheath-core type, or cross-bar shape.

5. Cold weather protective clothing manufactured using the heat-storing and retaining fleece of claim 1.

* * * * *